US006193349B1

(12) United States Patent
Cornell et al.

(10) Patent No.: US 6,193,349 B1
(45) Date of Patent: Feb. 27, 2001

(54) INK JET PRINT CARTRIDGE HAVING ACTIVE COOLING CELL

(75) Inventors: Robert Wilson Cornell; William Paul Cook; Gary Allen Denton; James Harold Powers, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 08/878,284

(22) Filed: Jun. 18, 1997

(51) Int. Cl.[7] ..... B41J 29/377
(52) U.S. Cl. ..... 347/18
(58) Field of Search ..... 347/18, 60, 62, 347/17

(56) References Cited

U.S. PATENT DOCUMENTS

| | | | | |
|---|---|---|---|---|
| 4,296,421 | * | 10/1981 | Hara et al. | 346/140 R |
| 4,376,945 | | 3/1983 | Hara et al. | 346/140 R |
| 4,707,705 | | 11/1987 | Hara et al. . | |
| 4,723,129 | | 2/1988 | Endo et al. | 346/1.1 |
| 4,751,528 | | 6/1988 | Spehrley, Jr. et al. | 346/140 R |
| 4,797,837 | * | 1/1989 | Brooks | 364/519 |
| 4,819,011 | | 4/1989 | Yokota . | |
| 4,831,390 | | 5/1989 | Deshpande et al. . | |
| 5,066,964 | | 11/1991 | Fukuda et al. | 346/140 R |
| 5,107,276 | | 4/1992 | Kneezel et al. . | |
| 5,121,343 | * | 6/1992 | Faris | 395/111 |
| 5,175,565 | | 12/1992 | Ishinaga et al. . | |
| 5,272,491 | | 12/1993 | Asakawa et al. . | |
| 5,500,667 | | 3/1996 | Schwiebert et al. . | |
| 5,610,635 | * | 3/1997 | Murray et al. | 347/7 |
| 5,622,897 | | 4/1997 | Hayes . | |

FOREIGN PATENT DOCUMENTS

| | | | | |
|---|---|---|---|---|
| 93 17870 | | 9/1993 | (AU) | B41J/2/195 |
| 0885737 | | 12/1998 | (EP) . | |
| 54-051837 | | 4/1979 | (JP) . | |
| 54-160240 | | 12/1979 | (JP) . | |
| 55-082663 | | 6/1980 | (JP) . | |
| 60-115450 | | 6/1985 | (JP) | B41J/3/04 |
| 60-115457 | | 6/1985 | (JP) | B41J/3/04 |
| 61-242847 | | 10/1986 | (JP) . | |
| 01063148 | | 3/1989 | (JP) . | |
| 64-63148 | | 3/1989 | (JP) | B41J/3/04 |
| 01108051 | | 4/1989 | (JP) . | |
| 03202361 | | 9/1991 | (JP) . | |
| 404353462 | * | 12/1992 | (JP) | B41J/2/05 |
| 05031902 | | 2/1993 | (JP) . | |
| 05201102 | | 8/1993 | (JP) . | |
| WO 93/17870 | * | 6/1993 | (WO) | B41J/2/195 |

OTHER PUBLICATIONS

G.A. Ruddy, IBM Technical Disclosure Bulletin, Published 1974, p. 3295.

* cited by examiner

*Primary Examiner*—John Barlow
*Assistant Examiner*—A. Dudding
(74) *Attorney, Agent, or Firm*—Michael T. Sanderson

(57) ABSTRACT

An ink jet print cartridge is provided for use in an ink jet printer. The cartridge comprises a printhead including a heater chip. The printhead is adapted to generate ink droplets in response to the heater chip receiving energy pulses from a printer energy supply circuit. A peltier effect cooling cell is associated with the heater chip for cooling the heater chip. The cooling cell receives current from the printer energy supply circuit as a function of energy flow to the heater chip.

22 Claims, 8 Drawing Sheets

INK JET PRINT CARTRIDGE HAVING ACTIVE COOLING CELL

CROSS-REFERENCE TO RELATED APPLICATION

This application is related to contemporaneously filed U.S. patent application Ser. No. 08/87,866, entitled "INK JET PRINT CARTRIDGE HAVING ACTIVE COOLING CELL," by Cornell et al., which is incorporated by reference herein.

FIELD OF THE INVENTION

This invention relates to ink jet print cartridges having a cooling cell for cooling a heater chip forming part of the cartridge printhead and/or ink provided in the cartridge container.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge orifice. A plurality of chambers, each provided with a single heating element, are provided in the printer's printhead. The printhead typically comprises the heater chip and a plate having a plurality of the discharge orifices formed therein. The printhead forms part of an ink jet print cartridge which also comprises an ink-filled container.

Heater chips need to be maintained within a reasonably small temperature range for proper operation. Many techniques have been developed for transferring heat away from the heater chip so as to maintain the chip within the desired temperature range. However, as ink jet technology advances, heater chips are being populated with ever increasing numbers of heating elements. Further, heating element firing frequencies are increasing. Hence, alternative cooling techniques which are more effective and/or less costly than conventional cooling techniques are desired.

SUMMARY OF THE INVENTION

In accordance with the present invention, an ink jet print cartridge is provided for use in an ink jet printer. The cartridge comprises a printhead including a heater chip. The printhead is adapted to generate ink droplets in response Lo the heater chip receiving energy pulses from a printer energy supply circuit. A peltier effect cooling cell is associated with the heater chip for cooling the heater chip, The cooling cell may directly contact the heater chip. Alternatively, it may be spaced from the heater chip. In the latter embodiment, a thermally conductive material extends between the heater chip and the cooling cell and provides a path for energy in the form of heat to move from the heater chip to the cooling cell. The thermally conductive material may also extend into the flow path of the ink. A heat sink may be provided to transfer heat to air outside of the cartridge. The cooling cell preferably receives current from the printer energy supply circuit as a function of energy flow to the heater chip. Alternatively, a temperature. sensor for sensing the temperature of the heater chip may be provided and signals from the sensor may be used to control the amount of current provided to the cooling cell from the printer energy supply circuit.

DETAILED DESCRIPTION OF THE PREFERRED EMBODIMENTS

Figure 1:
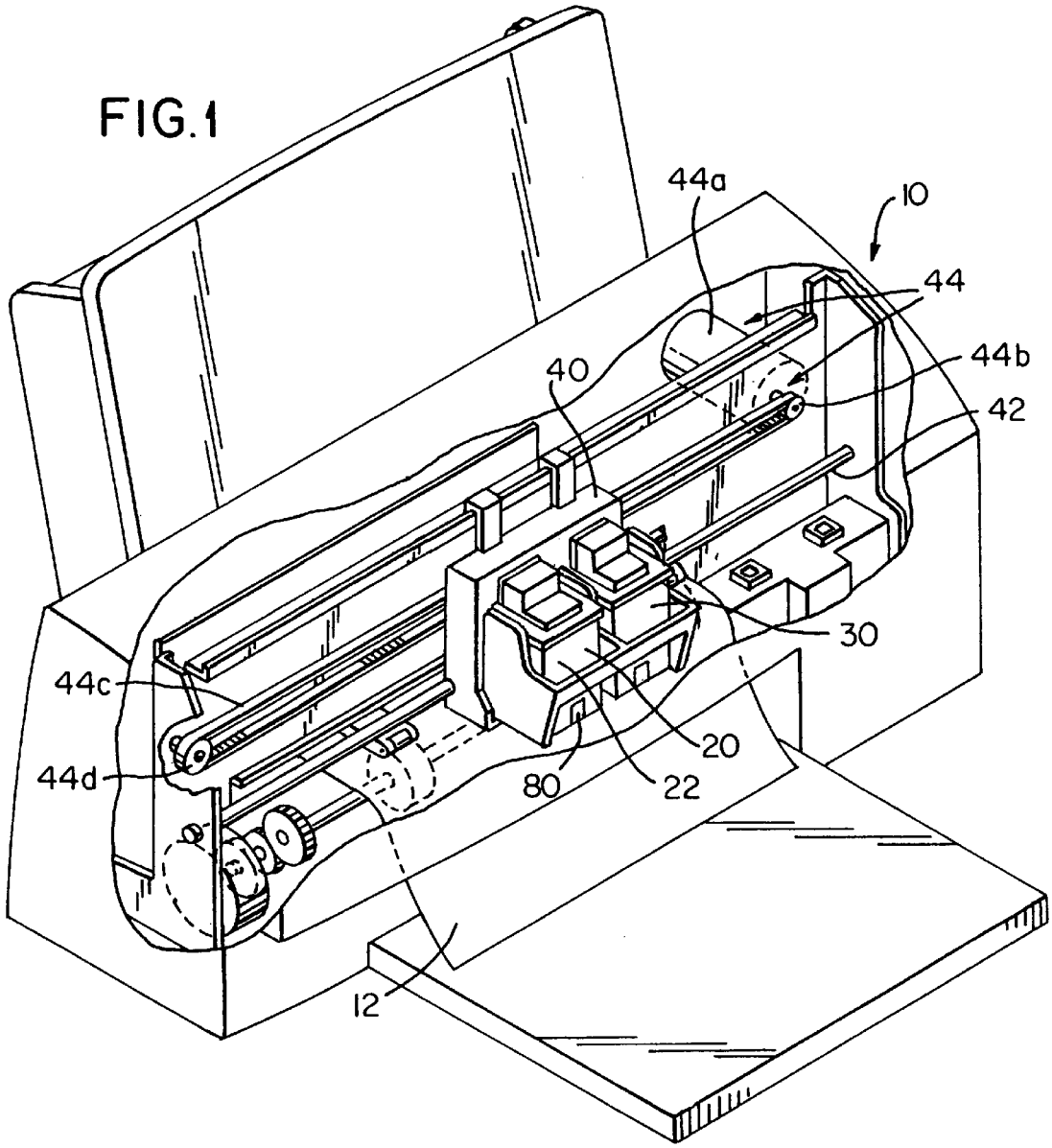
FIG. 1 is a perspective view of an ink jet printing apparatus having first and second print cartridges constructed in accordance with the present invention.

Referring now to FIG. 1, there is shown an ink jet printing apparatus 10 having first and second print cartridges 20 and 30 constructed in accordance with the present invention. The cartridges 20 and 30 are supported in a carrier 40.which, in turn, is slidably supported on a guide rail 42. A drive mechanism 44 is provided for effecting reciprocating movement of the carrier 40 back and forth along the guide rail 42. The drive mechanism 44 includes a motor 44*a* with a drive pulley 44*b* and a drive belt 44*c* which extends about the drive pulley 44*b* and an idler pulley 44*d*. The carrier 40 is fixedly connected to the drive belt 44*c* so as to move with the drive belt 44*c*. Operation of the motor 44*a* effects back and forth movement of the drive belt 44*c* and, hence, back and forth movement of the carrier 40 and the print cartridges 20 and 30. As the print cartridges 20 and 30 move back and forth, they eject ink droplets onto a paper substrate 12 provided below them. In the illustrated embodiment, the first print cartridge 20 ejects black ink droplets while the second print cartridge 30 ejects color droplets of either cyan, magenta or yellow ink. Only the first print cartridge 20 will be discussed in detail herein as the second print cartridge 30 is constructed in essentially the same manner as the first print cartridge 20.

Figure 2:
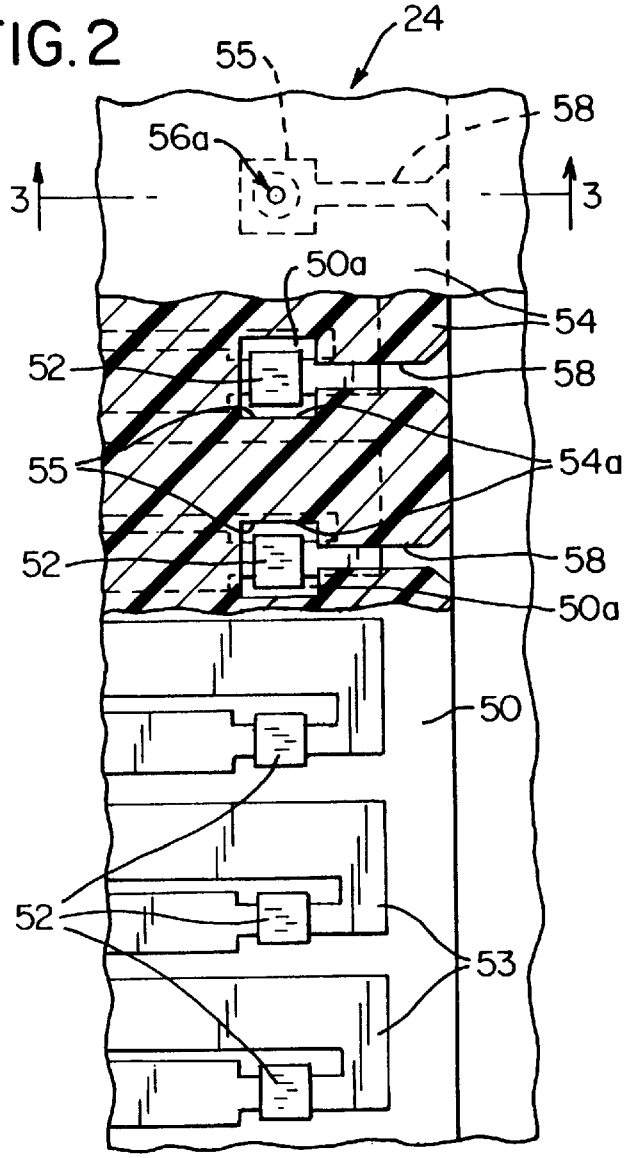
FIG. 2 is a view of a portion of a heater chip coupled to an orifice plate with sections of the orifice plate removed at two different levels.
Figure 3:
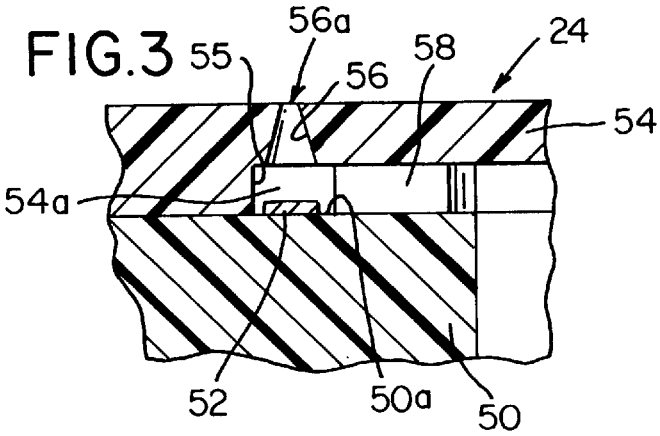
FIG. 3 is a view taken along section line 3—3 in FIG. 2.
Figure 4:
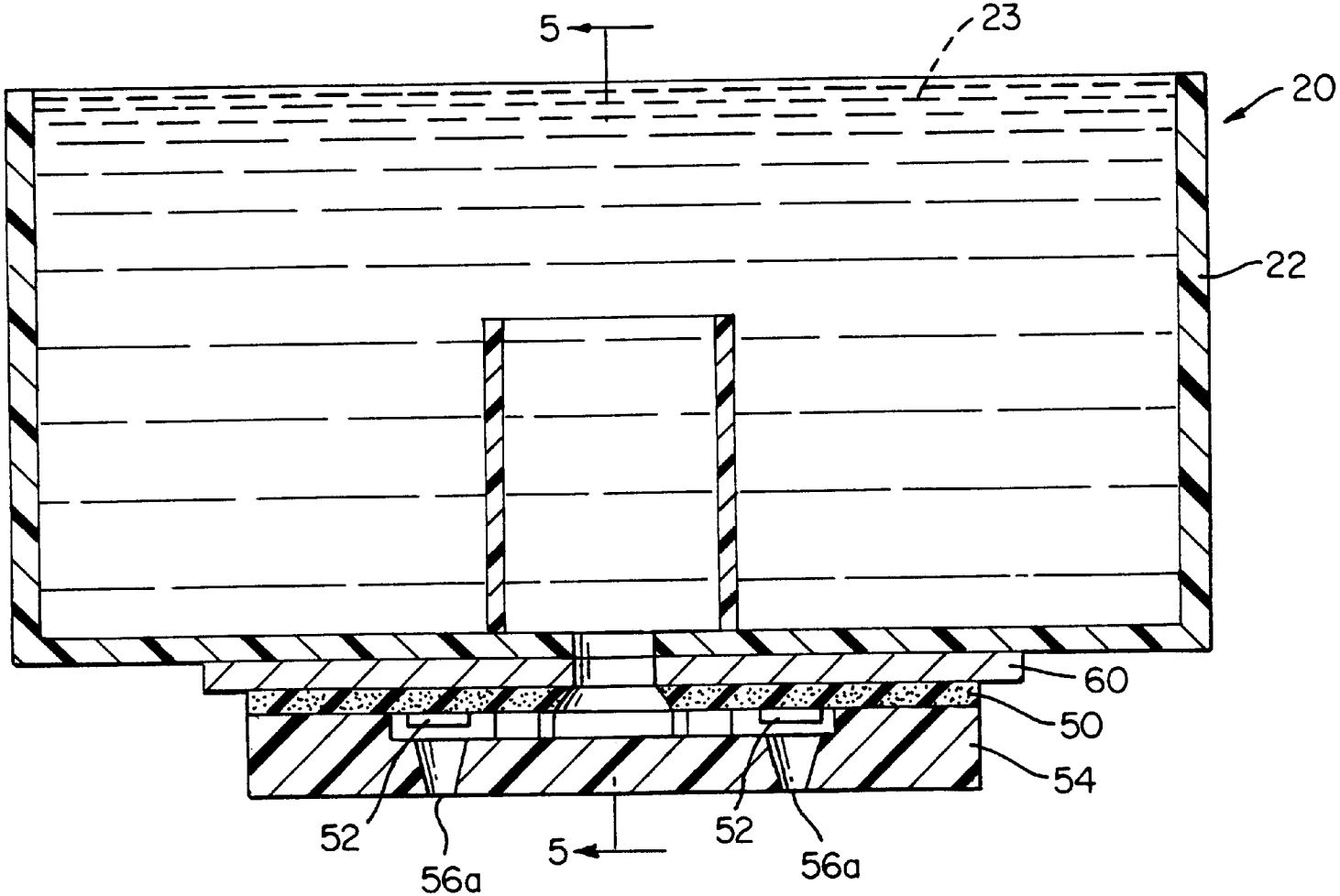
FIG. 4 is a cross-sectional view of a portion of a print cartridge formed in accordance with a first embodiment of the present invention.

The print cartridge 20 comprises a polymeric container 22, see FIG. 1, filled with ink and a printhead 24, see FIGS. 2 and 3. The printhead 24 comprises a heater chip 50 having a plurality of resistive heating elements 52. The printhead 24 further includes a plate 54 having a plurality of openings 56 extending through it which define a plurality of orifices 56*a* through which droplets are ejected.

The plate 54 may be bonded to the chip 50 via any art recognized technique, including a thermo compression bonding process. When the plate 54 and the heater chip 50 are joined together, sections 54*a* of the plate 54 and portions 50*a* of the heater chip 50 define a plurality of bubble chambers 55. Ink supplied by the container 22 flows into the bubble chambers 55 through ink supply channels 58. The resistive heating elements 52 are positioned on the heater chip 50 such that each bubble chamber 55 has only one heating element 52. Each bubble chamber 55 communicates with one orifice 56*a*, see FIG. 3.

Figure 5:
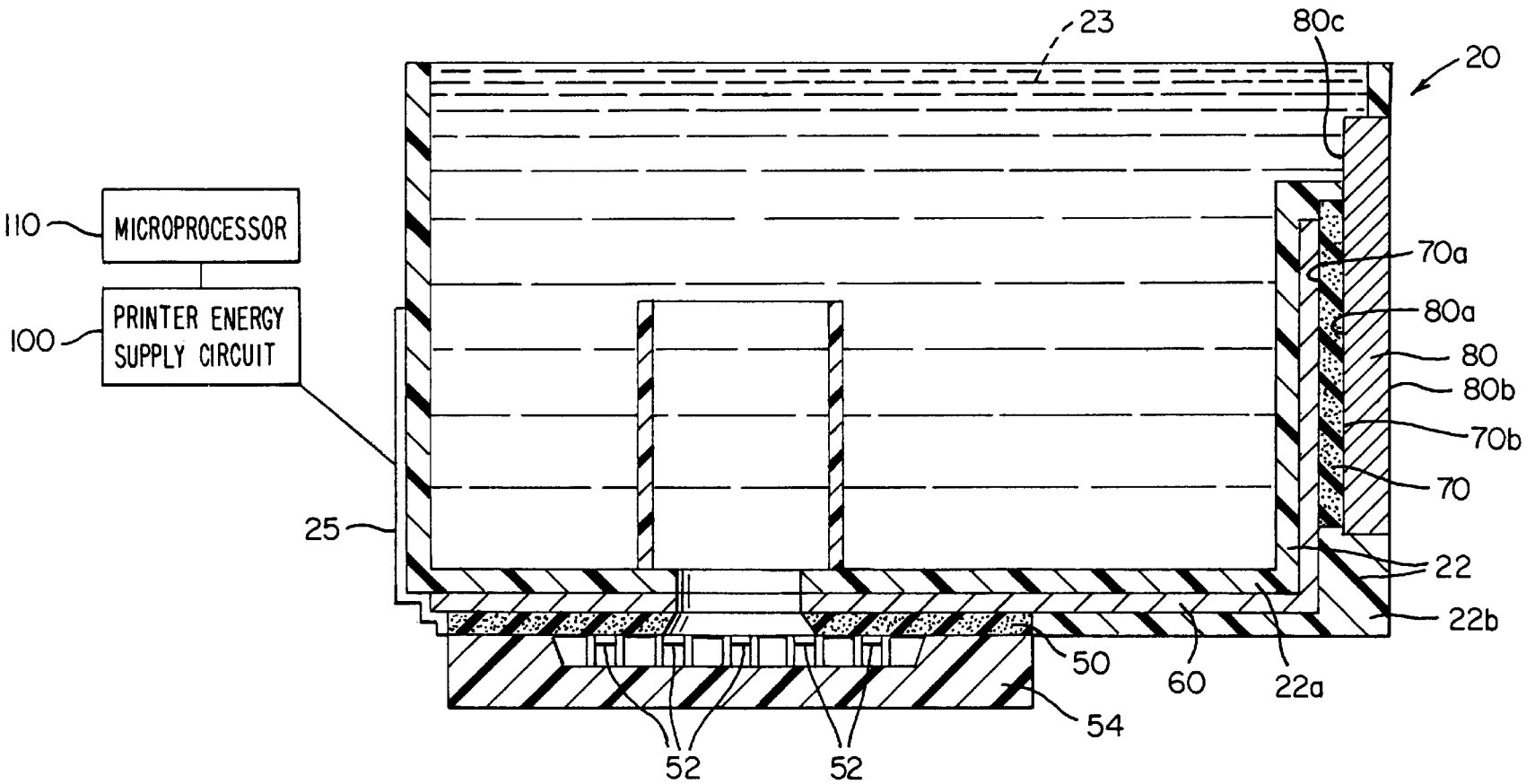
FIG. 5 is a view taken along view line 5—5 in FIG. 4.

The resistive heating elements 52 are individually addressed by voltage pulses provided by a printer energy supply circuit 100, see FIG. 5. Each voltage pulse is applied to one of the heating elements 52 to momentarily vaporize the ink in contact with that heating element 52 to form a bubble within the bubble chamber 55 in which the heating element 52 is located. The function of the bubble is to displace ink within the bubble chamber 55 such that a droplet of ink is expelled from an orifice 56*a* associated with the bubble chamber 55.

A flexible circuit 25 secured to the polymeric container 22 is used to provide a path for energy pulses to travel from the printer energy supply circuit 100 to the heater chip 50, see FIG. 5. Bond pads (not shown) on the heater chip 50 are bonded to end sections of traces (not shown) on the flexible circuit 25. Current flows from the printer energy supply circuit 100 to the traces on the flexible circuit 25 and from the traces to the bond pads on the heater chip 50. The current then flows from the bond pads along conductors 53 to the heating elements 52. A flexible circuit coupled to heater chip bond pads is disclosed in commonly assigned, copending patent application, U.S. Ser. No. 08/827,140, entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL," by Singh et al., filed on Mar. 27, 1997, and the disclosure of which is hereby incorporated by reference.

In accordance with a first embodiment of the present invention, a layer 60 of thermally conductive material is located between the container 22 and the heater chip 50 so as to directly contact the heater chip 50, see FIG. 5. Any one of a number of thermally conductive materials may be used to form the layer 60 such as gold, aluminum, stainless steel, copper with or without a protective plating of nickel or chromium, carbon-filled polymers, and thermally conductive ceramics. If ink 23 contacts the layer 60, a substantially non-corrosive, thermally conductive material, such as aluminum, aluminum or copper with a protective plating of nickel or chromium, may be preferred.

The layer 60 is substantially L-shaped, as shown in FIG. 5, and extends between inner and outer portions 22*a* and 22*b* of the container 22. Preferably, the container 22 is formed from a thermally insulative polymeric material. In the illustrated embodiment, the container 22 is formed from polyphenylene oxide, which is commercially available from the General Electric Company under the trademark "NORYL SE-1." Other polymeric materials not explicitly set out herein may also be used.

A thermoelectric cooling cell 70 is coupled to the container 22 via a thermally conductive adhesive such that a first surface 70*a* of the cooling cell 70 contacts the conductive layer 60, see FIG. 5. A heat sink 80 is positioned adjacent to the cooling cell 70 such that an inner surface 80*a* of the heat sink 80 contacts a second surface 70*b* of the cooling cell 70. An outer surface 80*b* of the heat sink 80 is exposed to air. The heat sink 80 may have fins or ribs (not shown) to maximize heat transfer to the air. The conductive layer 60 provides a path for energy in the form of heat to flow from the heater chip 50 to the cooling cell 70. The cooling cell 70 transfers heat away from the conductive layer 60 to the heat sink 80 where the energy is dissipated to outside air exposed to the second surface 80*b* of the heat sink 80. In the illustrated embodiment, a portion 80*c* of the heat sink 80 contacts the ink 23 to permit heat to be transferred directly from the heat sink 80 to the ink 23. Heating the ink has the advantage that some dissolved gases in the ink will be devolved thus reducing the formation of gas bubbles near the heater chip 50 which can cause print defects. In another embodiment (not shown), the heat sink 80 is not in contact with the ink at surface 80*c*, but is enclosed by thermally insulative polymeric material and is solely in contact with outside air for heat exchange from the cooling cell 70. In yet another embodiment (not shown), the heat sink 80 is not in contact with outside air, but is solely in contact with ink 23 for heat exchange from the cooling cell 70.

Any one of a number of thermally conductive materials may be used to form the heat sink 80 such as gold, copper with or without a protective plating of nickel or chromium, aluminum, stainless steel, carbon-filled polymers, and thermally conductive ceramics. If ink 23 contacts the heat sink 80, a substantially non-corrosive, thermally conductive material, such as aluminum or copper with a protective plating of nickel or chromium, may be preferred.

In the illustrated embodiment, the cell 70 comprises a peltier effect cooling cell. It may be formed from p-type and n-type semiconductor materials which are combined to form a pn junction. The preferred p-type materials include alloys of bismuth, tellurium and antimony while the preferred n-type materials include bismuth, tellurium and selenium. Conductor lines (not shown) extend from the flexible circuit 25 to the cooling cell 70. The conductor lines may extend along the outer surface of the container 22 or may be embedded within the container 22. Energy provided to the cooling cell 70 from the printer energy supply circuit 100 passes through the flexible circuit 25 and the conductor lines to the cooling cell 70. Heat is evolved or absorbed at the pn junction depending upon the direction of the current passing through it. The amount of heat evolved or absorbed is a function of current flow through the pn junction of the cell 70. Many forms of peltier effect cooling cells are commercially available and may be selected depending upon the physical shape and size requirements as well as the heat load they are to handle.

In the illustrated embodiment, a microprocessor 110 constantly monitors power provided by the printer energy supply circuit 100 to the heater chip 50. A typical amount of energy required to fire one of the heating elements 52 is stored in the microprocessor 110. By multiplying this typical energy amount by the number of heating elements 52 fired in a given time period, the microprocessor 110 determines estimated power provided to the heater chip 50 during the given time period. The microprocessor 110 then causes the energy supply circuit 100 to supply current to the cooling cell 70 as a function of energy flow or estimated power provided to the heater chip 50 so as to cool the heater chip 50 and maintain the temperature of the heater chip 50 substantially constant or within a desired temperature range. It is presently preferred for current to he provided to the cooling cell 70 in direct proportion to the printload such that as printload increases, current provided to the cooling cell 70 increases and as printload decreases, current provided to the cooling cell 70 decreases.

Figure 6:
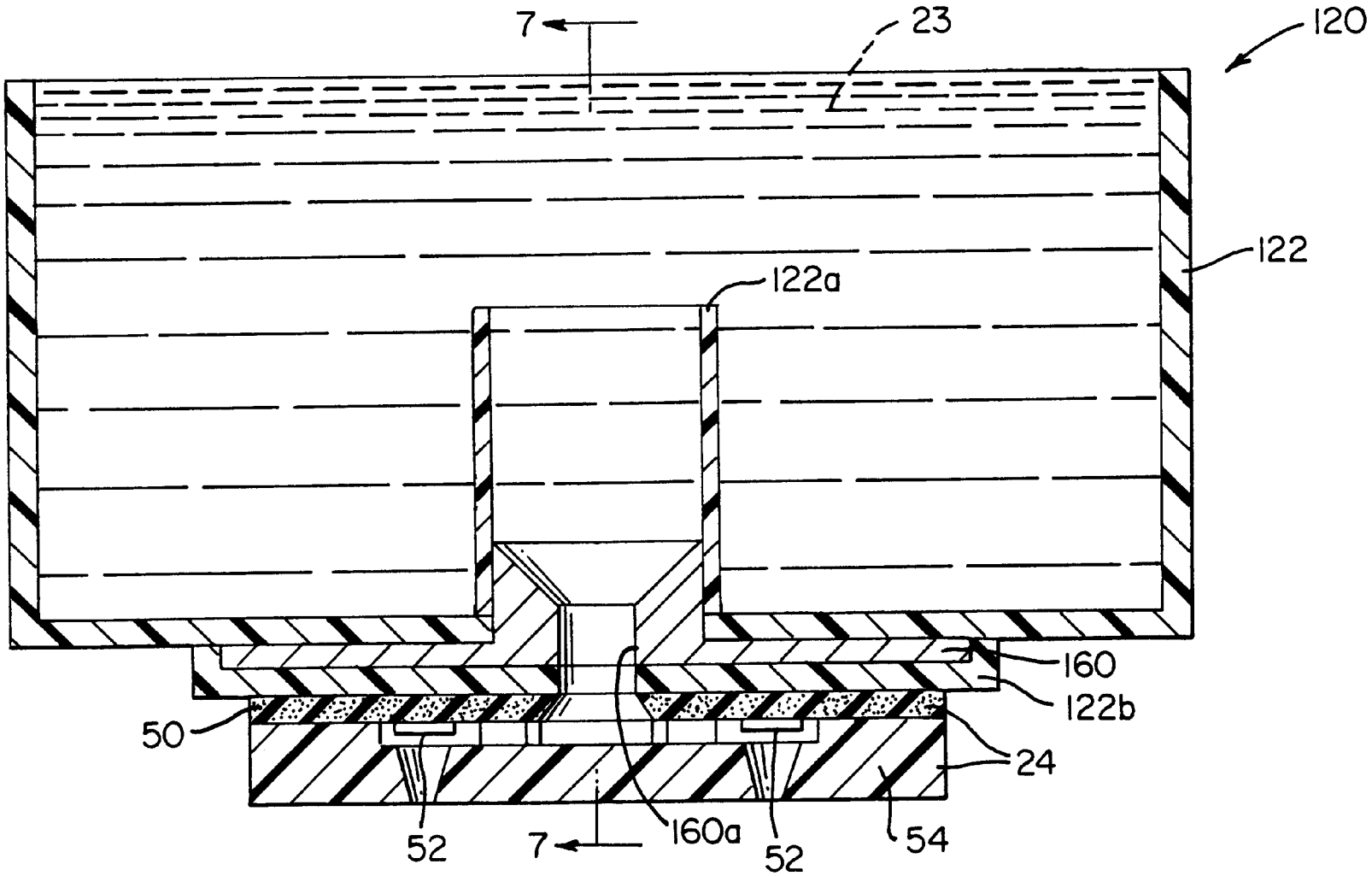
FIG. 6 is a cross-sectional view of a portion of a print cartridge formed in accordance with a second embodiment of the present invention.
Figure 7:
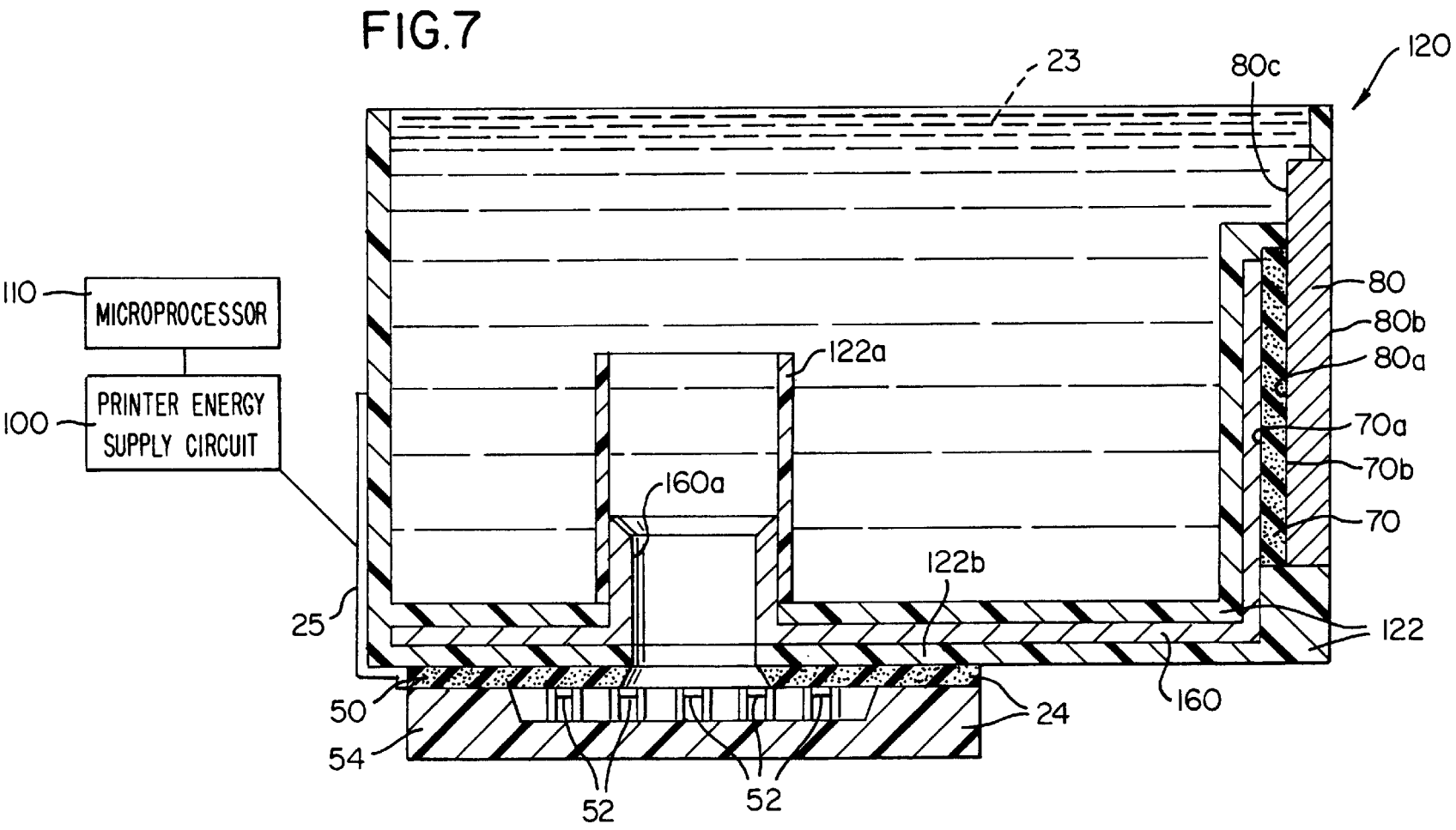
FIG. 7 is a view taken along view line 7—7 in FIG. 6.

A print cartridge 120 constructed in accordance with a second embodiment of the present invention is illustrated in FIGS. 6 and 7, wherein like reference numerals indicate like elements. Tie print cartridge 120 includes an ink-filled container 122 which preferably is formed from a thermally non-conductive polymeric material. The container 122 includes an internal standpipe 122*a* which is preferably formed from a thermally non-conductive polymeric material. A layer 160 of thermally conductive material extends into the standpipe 122*a* and defines an internal passageway 160*a* through which the ink flows as it moves into the printhead 24. The layer of conductive material 160 also extends to the cooling cell 70 such that it contacts a first surface 70*a* of the cooling cell 70. Any one of a number of thermally conductive materials may be used to form the layer 160, such as gold, aluminum, stainless steel, copper with or without a protective plating of nickel or chromium, carbon-filled polymers, and thermally conductive ceramics. Because ink 23 contacts the layer 160, a substantially non-corrosive, thermally conductive material, such as aluminum, or copper with a protective plating of nickel or chromium, may be preferred.

As the ink 23 flows through the passageway 160*a* and contacts the thermally conductive material 160, energy in the form of heat is removed from the ink 23. The energy moves via conduction along the material layer 160 to the cooling cell 70. The cooling cell 70 then transfers the heat to the heat sink 80 where the energy is dissipated to outside air.

Typically, ink contained in an ink jet print cartridge container contains dissolved gases, primarily nitrogen, oxygen and carbon dioxide. As the ink passes into and through the print cartridge printhead, its temperature increases. Since gas solubility in ink decreases as ink temperature increases, air may come out of solution as the ink moves into and through the printhead resulting in the formation of gas bubbles in the printhead. Those gas bubbles may block the flow of ink through the printhead, resulting in a print defect. In the present invention, because the ink 23 is cooled before it enters the printhead 24, air is less likely to come out of solution as the ink 23 passes through the printhead 24. The cooled ink 23 also serves to cool the heater chip 50 as it flows into and through the printhead 24.

Since ink cooling takes place solely in the standpipe 122*a* in the illustrated embodiment, only a very small quantity of ink about to be used for printing is cooled. This is preferred over cooling all of the ink in the container 122, which would require more power and encourage the absorption of additional gases into the ink, which is undesirable.

In the embodiment illustrated in FIGS. 6 and 7, the thermally conductive layer 160 is encased within the polymeric container 122 such that a layer of thermally insulating polymeric material 122*b* is located between the thermally conductive layer 160 and the heater chip 50. This allows the heat to be extracted from the ink only, lowering its temperature and reducing problems associated with gases devolving from the ink due to a temperature rise in proximity to the heater chip 50. A significant temperature drop could cause previously generated bubbles in the area of the heater chip 50 to dissolve back into the ink. It is also contemplated that the thermally conductive layer 160 may directly contact the heater chip 50 so as to provide a path for heat to move from the heater chip 50 to the cooling cell 70 though this configuration would provide more benefit to directly cooling the heater chip 50, and could increase the temperature of the ink in proximity to the heater chip 50.

As noted above, it is preferred that current be supplied to the cooling cell 70 as a function of printload. It is also contemplated that an ink temperature sensor (not shown) may be provided in the standpipe 122*a* or between the heater chip 50 and the standpipe 122*a* for generating feedback signals to the microprocessor 110 representative of ink temperature. Based upon these signals, the microprocessor 110 causes the energy supply circuit 100 to supply an appropriate amount of current to the cooling cell 70 to maintain the temperature of the ink 23 substantially constant or within a desired temperature range. The temperature sensor may comprise a conventional thermistor or thermocouple.

It is further contemplated that a heater chip temperature sensor (not shown) may be provided on or incorporated within the heater chip 50 which generates feedback signals to the microprocessor 110 representative of the heater chip's temperature. Based upon these signals, the microprocessor 110 causes the energy supply circuit 100 to supply an appropriate amount of current to the cooling cell 70 to maintain the temperature of the heater chip 50 substantially constant or within a desired temperature range. The temperature sensor may comprise a conventional thermistor or thermocouple.

Figure 8:
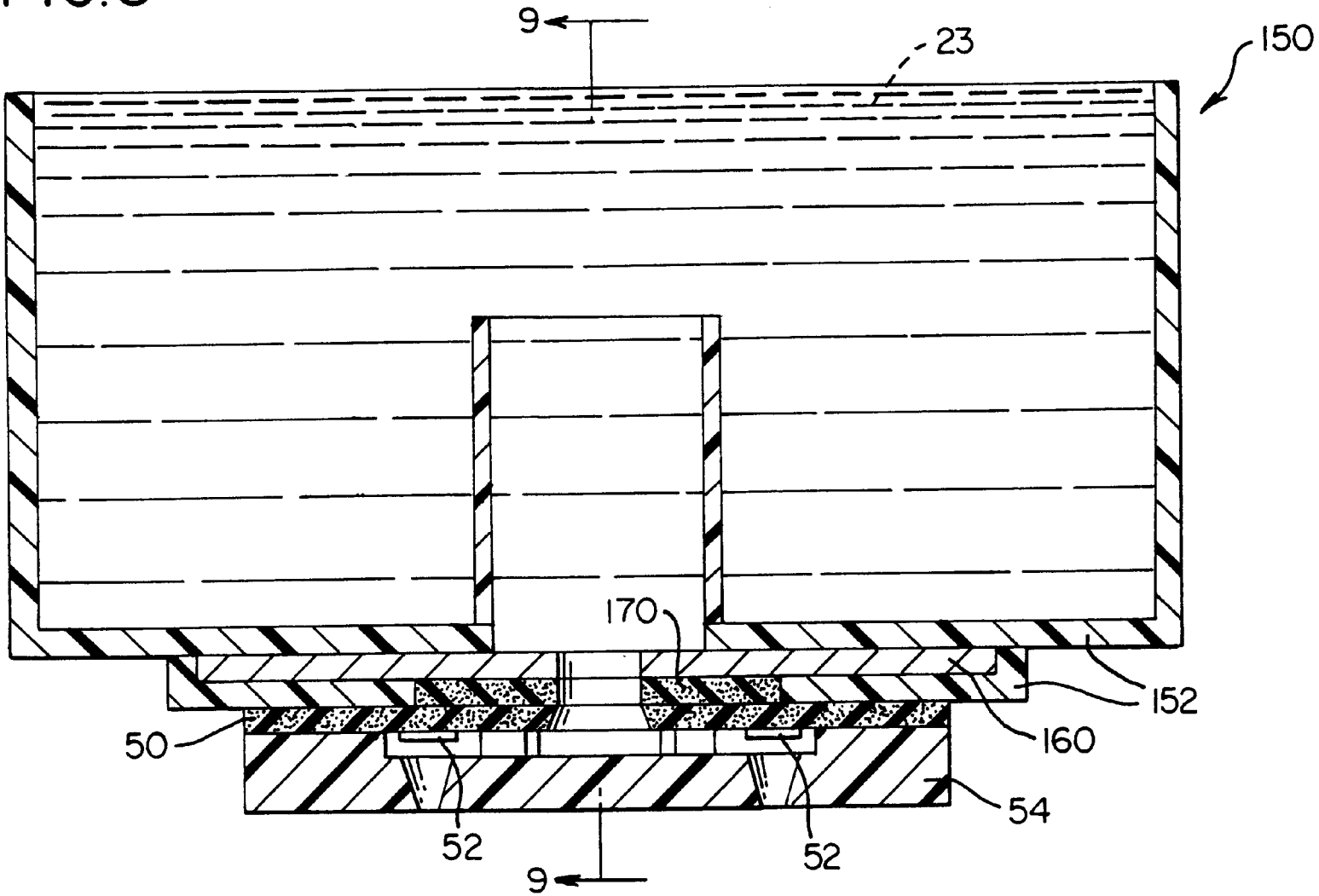
FIG. 8 is a cross-sectional view of a portion of a print cartridge formed in accordance with a third embodiment of the present invention.
Figure 9:
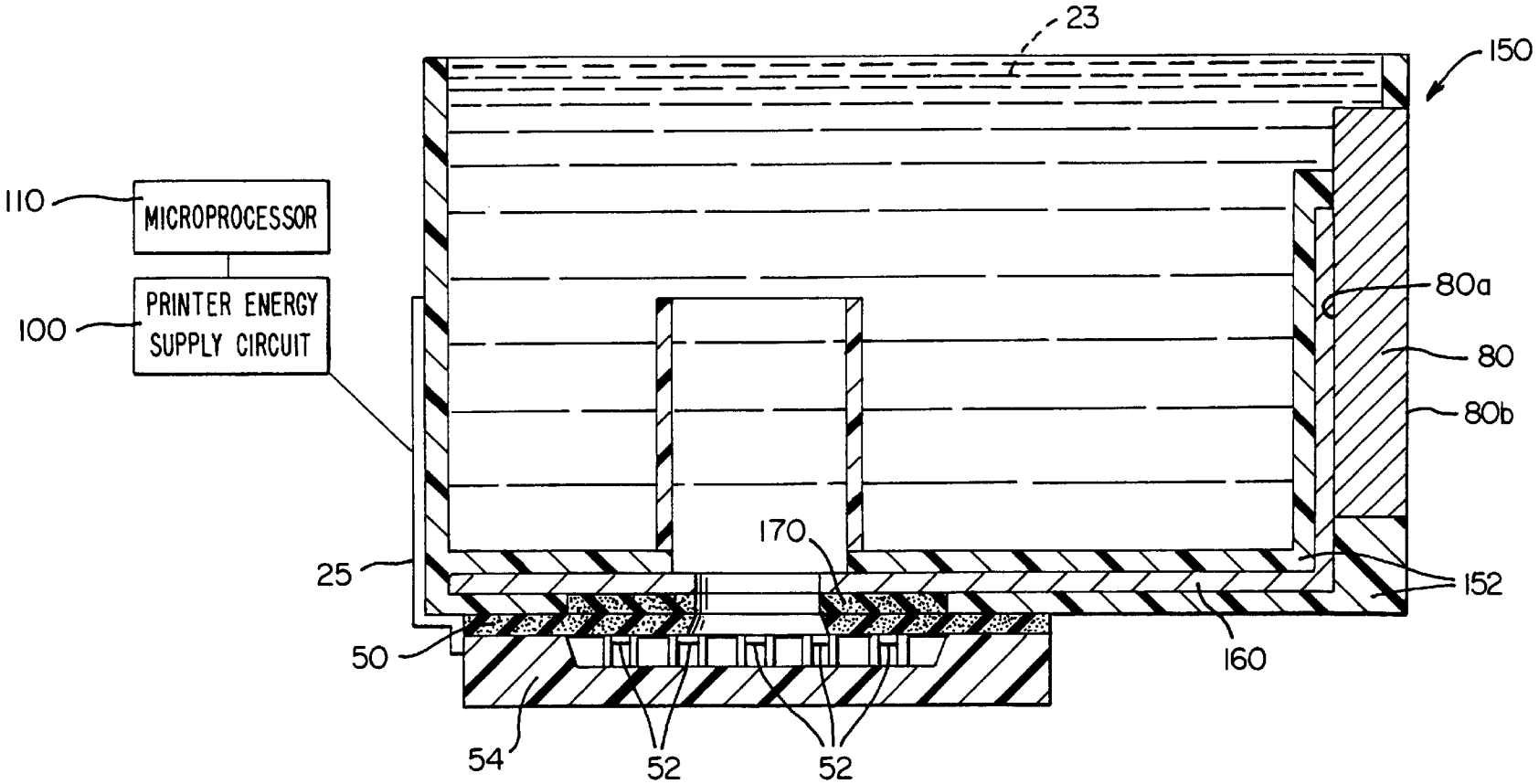
FIG. 9 is a view taken along view line 9—9 in FIG. 8.

A print cartridge 150 constructed in accordance with a third embodiment of the present invention is illustrated in FIGS. 8 and 9, wherein like reference numerals indicate like elements. The print cartridge 150 includes an ink-filled container 152 which preferably is formed from the same material used to form the container 22. The cartridge 150 additionally includes an appropriately sized cooling cell 170 which directly contacts the heater chip 50 to cool same. A layer of thermally conductive material 160 extends from the cooling cell 170 to a heat sink 80 so as to provide a path for energy in the form of heat to flow from the cooling cell 170 to the heat sink 80. The thermally conductive layer 160 may be formed from any one of the materials set out above from which the conductive layer 60 is made. Further, the thermally conductive layer 160 and the heat sink 80 may comprise a single integral element. The cooling cell 170 may be operated and controlled in the same fashion as the cooling cell 70 described above.

It is still further contemplated that one or more cooling cells may be used to cool a pagewide printhead.

What is claimed is:

1. An ink jet print cartridge for use in an ink jet printer having a processor adapted to monitor power delivered to printer components comprising:

a printhead including a heater chip, said printhead adapted to generate ink droplets in response to said heater chip receiving energy pulses from a printer energy supply circuit; and a thermoelectric cooling cell associated with said heater chip for cooling said heater chip, said cooling cell receiving current from said printer energy supply circuit as a function of energy flow to said heater chip.

2. An ink jet print cartridge as set forth in claim 1, wherein said cooling cell contacts said heater chip.

3. An ink jet print cartridge as set forth in claim 1, wherein said cooling cell is spaced from said heater chip.

4. An ink jet print cartridge as set forth in claim 3, further comprising a thermally conductive material extending between and contacting said heater chip and said cooling cell, said conductive material providing a path for energy in the form of heat to flow from said heater chip to said cooling cell.

5. An ink jet print cartridge as set forth in claim 3, further comprising a heat sink which contacts said cooling cell.

6. An ink jet print cartridge as set forth in claim 1, wherein said heater chip includes a plurality of resistive healing elements and said printhead further comprises an orifice plate which is coupled to said heater chip such that sections of said orifice plate and portions of said heater chip define a plurality of ink-containing chambers, and said plurality of resistive heating elements are positioned on said heater chip such that each of said ink-containing chambers has one of said heating elements associated therewith.

7. An ink jet print cartridge for use in an ink jet printer comprising:

a printhead including a heater chip, said printhead adapted to generate ink droplets in response to said heater chip receiving energy pulses from a printer energy supply circuit;

an ink-filled container coupled to said printhead for providing ink to said printhead, said printhead being positioned on a first surface of said container;

a cooling cell spaced from said heater chip and coupled to a second surface of said container; and a thermally non-fluid conductive material extending between and contacting said cooling cell and said heater chip, said conductive material providing a path for energy in the form of heat to flow from said heater chip to said cooling cell.

8. An ink jet print cartridge as set forth in claim 7, wherein said first container surface is in a first plane and said second container surface is in a second plane which is generally orthogonal to said first plane.

9. An ink jet print cartridge as set forth in claim 7, further comprising a heat sink which contacts said cooling cell.

10. An ink jet print cartridge as set forth in claim 9, wherein said heat sink is exposed to air such that heat is transferred from said cooling cell to said heat sink and from said heat sink to the air.

11. An ink jet print cartridge as set forth in claim 10, wherein said heat sink is further exposed to ink in said container such that heat is transferred from said cooling cell to said heat sink and from said heat sink to the air and the ink.

12. An ink jet print cartridge as set forth in claim 9, wherein said heat sink is exposed to ink in said container such that heat is transferred from said cooling cell to said heat sink and from said heat sink to the ink.

13. An ink jet print cartridge for use in an ink jet printer having a processor adapted to monitor power associated with printload comprising:

a printhead including a heater chip, said printhead adapted to generate ink droplet in response to said heater chip receiving energy pulses from a printer energy supply circuit; and a thermoelectric cooling cell associated with said heater chip for cooling said heater chip in response to said cooling cell receiving current from said printer energy supply circuit, said current to said cooling cell varying as a function of printload.

14. An ink jet print cartridge as set forth in claim 13, wherein said cooling cell comprises a thermoelectric cooling cell.

15. An ink jet print cartridge as set forth in claim 14, wherein said cooling cell contacts said heater chip.

16. An ink jet print cartridge as set forth in claim 14, wherein said cooling cell is spaced from said heater chip.

17. A method for cooling a heater chip in an ink jet print cartridge of a printer having a processor adapted to monitor drive signal power delivered to printer components, said heater chip receiving energy pulses from a printer energy supply circuit, said method comprising the steps of:

providing a thermoelectric cooling cell;

arranging said cooling cell such that it is in thermal communication with said heater chip;

monitoring the power from said printer energy supply circuit to said heater chip; and supplying current to said cooling cell as a function of power to said heater chip.

18. A method as set forth in claim 17, wherein said arranging step comprises the step of positioning said cooling cell directly adjacent to said heater chip.

19. A method as set forth in claim 17, wherein said arranging step comprises the steps of:

spacing said cooling cell from said heater chip; and providing a thermally conductive material extending between and contacting said cooling cell and said heater chip, said conductive material providing a path for energy in the form of heat to flow from said heater chip to said cooling cell.

20. An ink jet printer comprising:

a printer energy supply circuit;

a printhead including a heater chip, said printhead adapted to generate ink droplets in response to said heater chip receiving energy pulses from said printer energy supply circuit;

a thermoelectric cooling cell associated with said heater chip for cooling said heater chip in response to current supplied to said cooling cell by said printer energy supply circuit; and a processor coupled to said printer energy supply circuit for monitoring power from said energy supply circuit to said heater chip and for controlling the amount of current supplied by said energy supply circuit to said cooling cell as a function of power to said heater chip.

21. An ink jet printer as set forth in claim 20, wherein said cooling cell contacts said heater chip.

22. An ink jet print cartridge as set forth in claim 20, wherein said peltier effect cooling cell is spaced from said heater chip.

* * * * *